US010815551B2

(12) United States Patent
Wang et al.

(10) Patent No.: US 10,815,551 B2
(45) Date of Patent: Oct. 27, 2020

(54) ALUMINUM ALLOY MATERIAL AND HOUSING MADE OF ALUMINUM ALLOY MATERIAL

(71) Applicant: Huawei Technologies Co., Ltd., Shenzhen (CN)

(72) Inventors: Yongxiang Wang, Shenzhen (CN); Banghong Hu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 205 days.

(21) Appl. No.: 16/004,018

(22) Filed: Jun. 8, 2018

(65) Prior Publication Data

US 2018/0320253 A1 Nov. 8, 2018

Related U.S. Application Data

(63) Continuation of application No. PCT/CN2016/108903, filed on Dec. 7, 2016.

(30) Foreign Application Priority Data

Dec. 10, 2015 (CN) ..... 2015 1 0918675

(51) Int. Cl.
*C22C 21/10* (2006.01)

(52) U.S. Cl.
CPC ..... *C22C 21/10* (2013.01); *Y10T 428/12764* (2015.01)

(58) Field of Classification Search
None
See application file for complete search history.

(56) References Cited

U.S. PATENT DOCUMENTS 8,273,986 B2 * 9/2012 Liu ..... B44C 3/10 174/60
9,512,510 B2 * 12/2016 Hatta ..... C22C 21/00
(Continued)

FOREIGN PATENT DOCUMENTS

CN 101440448 * 5/2009
CN 101914710 A 12/2010
(Continued)

OTHER PUBLICATIONS

Machine Translation and Abstract of Japanese Publication No. JPS59118865, Part 1, Jul. 9, 1984, 7 pages.
(Continued)

*Primary Examiner* — Daniel J. Schleis
(74) *Attorney, Agent, or Firm* — Conley Rose, P.C.

(57) ABSTRACT

An aluminum alloy material includes zinc whose mass percentage is from 4.5% to 12.0%, magnesium whose mass percentage is from 0.7% to 3.0%, copper whose mass percentage is less than or equal to 0.6%, titanium whose mass percentage is from 0.001% to 0.5%, boron whose mass percentage is from 0.00011% to 0.2%, manganese whose mass percentage is less than or equal to 0.01%, chromium whose mass percentage is less than or equal to 0.2%, zirconium whose mass percentage is less than or equal to 0.2%, silicon whose mass percentage is less than or equal to 0.3%, ferrum whose mass percentage is less than or equal to 0.3%, aluminum, and other inevitable impurities.

12 Claims, 5 Drawing Sheets

(56) References Cited

U.S. PATENT DOCUMENTS

| | | | | |
|---|---|---|---|---|
| 2004/0101434 | A1* | 5/2004 | Fridlyander | C22C 21/10 420/532 |
| 2005/0238528 | A1 | 10/2005 | Lin et al. | |
| 2011/0008202 | A1* | 1/2011 | Fischer | C22C 1/06 420/532 |
| 2012/0234440 | A1 | 9/2012 | Miyata et al. | |
| 2014/0124103 | A1 | 5/2014 | Hatta | |
| 2014/0246127 | A1 | 9/2014 | Hatta et al. | |
| 2015/0217813 | A1 | 8/2015 | Smeyers et al. | |
| 2015/0218677 | A1 | 8/2015 | Aruga et al. | |
| 2015/0315680 | A1 | 11/2015 | Yan et al. | |
| 2016/0186302 | A1 | 6/2016 | Hatta et al. | |
| 2016/0215371 | A1 | 7/2016 | Lin | |
| 2017/0350032 | A1 | 12/2017 | Zeng | |

FOREIGN PATENT DOCUMENTS

| | | | |
|---|---|---|---|
| CN | 101935790 | A | 1/2011 |
| CN | 102230254 | A | 11/2011 |
| CN | 102489976 | A | 6/2012 |
| CN | 102676962 | A | 9/2012 |
| CN | 103732772 | A | 4/2014 |
| CN | 103732773 | A | 4/2014 |
| CN | 104018038 | A | 9/2014 |
| CN | 104178711 | A | 12/2014 |
| CN | 104278178 | A | 1/2015 |
| CN | 104561701 | A | 4/2015 |
| CN | 104619873 | A | 5/2015 |
| CN | 104703792 | A | 6/2015 |
| CN | 104745903 | A | 7/2015 |
| CN | 104762538 | A | 7/2015 |
| CN | 105008565 | A | 10/2015 |
| CN | 105063431 | A | 11/2015 |
| CN | 105112747 | A | 12/2015 |
| CN | 106255771 | A | 12/2016 |
| JP | S59118865 | A | 7/1984 |
| JP | S59143040 | A | 8/1984 |
| JP | S60194041 | A | 10/1985 |
| JP | S60234955 | A | 11/1985 |
| JP | S62130255 | A | 6/1987 |
| JP | H06128677 | A | 5/1994 |
| JP | H06128678 | A | 5/1994 |
| JP | 2544235 | B2 | 10/1996 |
| JP | H08295977 | A | 11/1996 |
| JP | 2002173729 | A | 6/2002 |
| JP | 2005307322 | A | 11/2005 |
| JP | 2011241449 | A | 12/2011 |
| JP | 2012246555 | A | 12/2012 |
| JP | 2013007085 | A | 1/2013 |
| JP | 2013007086 | A | 1/2013 |
| JP | 2013122083 | A | 6/2013 |
| WO | 2012176345 | A1 | 12/2012 |
| WO | 2012176346 | A1 | 12/2012 |
| WO | 2012176744 | A1 | 12/2012 |
| WO | 2013069603 | A1 | 5/2013 |
| WO | 2015025706 | A1 | 2/2015 |

OTHER PUBLICATIONS

Machine Translation and Abstract of Japanese Publication No. JPS59118865, Part 2, Jul. 9, 1984, 3 pages.
Machine Translation and Abstract of Japanese Publication No. JPS59143040, Part 1, Aug. 16, 1984, 6 pages.
Machine Translation and Abstract of Japanese Publication No. JPS59143040, Part 2, Aug. 16, 1984, 3 pages.
Machine Translation and Abstract of Japanese Publication No. JPS60234955, Part 1, Nov. 21, 1985, 5 pages.
Machine Translation and Abstract of Japanese Publication No. JPS60234955, Part 2, Nov. 21, 1985, 2 pages.
Machine Translation and Abstract of Japanese Publication No. JPS62130255, Part 1, Jun. 12, 1987, 5 pages.
Machine Translation and Abstract of Japanese Publication No. JPS62130255, Part 2, Jun. 12, 1987, 3 pages.
Machine Translation and Abstract of Chinese Publication No. CN101935790, Jan. 5, 2011, 5 pages.
Machine Translation and Abstract of Chinese Publication No. CN103732773, Apr. 16, 2014, 15 pages.
Machine Translation and Abstract of Chinese Publication No. CN104278178, Jan. 14, 2015, 7 pages.
Machine Translation and Abstract of Chinese Publication No. CN104561701, Apr. 29, 2015, 7 pages.
Machine Translation and Abstract of Chinese Publication No. CN104745903, Jul. 1, 2015, 12 pages.
Machine Translation and Abstract of Chinese Publication No. CN105112747, Dec. 2, 2015, 20 pages.
Foreign Communication From a Counterpart Application, Chinese Application No. 201510918675.9, Chinese Office Action dated Aug. 13, 2018, 10 pages.
Foreign Communication From a Counterpart Application, Chinese Application No. 201510918675.9, Chinese Search Report dated Aug. 3, 2018, 5 pages.
Machine Translation and Abstract of Chinese Publication No. CN101914710, Dec. 15, 2010, 9 pages.
Machine Translation and Abstract of Chinese Publication No. CN102230254, Nov. 2, 2011, 5 pages.
Machine Translation and Abstract of Chinese Publication No. CN102489976, Jun. 13, 2012, 4 pages.
Machine Translation and Abstract of Chinese Publication No. CN104018038, Sep. 3, 2014, 11 pages.
Machine Translation and Abstract of Chinese Publication No. CN104178711, Dec. 21, 2016, 8 pages.
Machine Translation and Abstract of Chinese Publication No. CN105063431, Nov. 18, 2015, 13 pages.
Machine Translation and Abstract of Japanese Publication No. JP2544235, Oct. 16, 1996, 11 pages.
Machine Translation and Abstract of Japanese Publication No. JP2002173729, Jun. 21, 2002, 15 pages.
Machine Translation and Abstract of Japanese Publication No. JP2005307322, Nov. 4, 2005, 9 pages.
Machine Translation and Abstract of Japanese Publication No. JP2011241449, Dec. 1, 2011, 5 pages.
Machine Translation and Abstract of Japanese Publication No. JP2012246555, Dec. 13, 2012, 7 pages.
Machine Translation and Abstract of Japanese Publication No. JP2013007086, Jan. 10, 2013, 13 pages.
Machine Translation and Abstract of Japanese Publication No. JP2013122083, Jun. 20, 2013, 18 pages.
Machine Translation and Abstract of Japanese Publication No. JPH06128677, May 10, 1994, 18 pages.
Machine Translation and Abstract of Japanese Publication No. JPH06128678, May 10, 1994, 18 pages.
Machine Translation and Abstract of Japanese Publication No. JPH08295977, Nov. 12, 1996, 8 pages.
Machine Translation and Abstract of Japanese Publication No. JPS60194041, Oct. 2, 1985, 2 pages.
Machine Translation and Abstract of International Publication No. WO2012176345, Dec. 27, 2012, 16 pages.
Machine Translation and Abstract of International Publication No. WO2012176346, Dec. 27, 2012, 16 pages.
Machine Translation and Abstract of International Publication No. WO2012176744, Dec. 27, 2012, 14 pages.
Machine Translation and Abstract of International Publication No. WO2013069603, May 16, 2013, 22 pages.
Songzan, R., et al., "Metallographic Analysis Principle and Technology," Shanghai Science and Technology Literature Publishing House, Aug. 31, 2013, 2 pages.
English Translation of Songzan, R., et al., "Metallographic Analysis Principle and Technology," Shanghai Science and Technology Literature Publishing House, Aug. 31, 2013, 1 pages.
Foreign Communication From a Counterpart Application, Chinese Application No. 201510918675.9, Chinese Office Action dated Jan. 2, 2018, 6 pages.
Foreign Communication From a Counterpart Application, Chinese Application No. 201510918675.9, Chinese Search Report dated Dec. 19, 2017, 2 pages.

(56) References Cited

OTHER PUBLICATIONS

Foreign Communication From a Counterpart Application, PCT Application No. PCT/CN2016/108903, English Translation of International Search Report dated Mar. 2, 2017, 2 pages.
Foreign Communication From a Counterpart Application, PCT Application No. PCT/CN2016/108903, English Translation of Written Opinion dated Mar. 2, 2017, 5 pages.

* cited by examiner

ALUMINUM ALLOY MATERIAL AND HOUSING MADE OF ALUMINUM ALLOY MATERIAL

CROSS-REFERENCE TO RELATED APPLICATIONS

This application is a continuation of International Patent Application No. PCT/CN2016/108903 filed on Dec. 7, 2016, which claims priority to Chinese Patent Application No. 2015/10918675.9 filed on Dec. 10, 2015. The disclosures of the aforementioned applications are hereby incorporated by reference in their entireties.

TECHNICAL FIELD

The present disclosure relates to the field of electronic communications technologies, and in particular, to an aluminum alloy material and a housing made of the aluminum (also referred to as Al) alloy material.

BACKGROUND

In recent years, a mobile terminal device (for example, a smartphone, a tablet computer, or an intelligent wearable device) is becoming lighter and thinner. When a light and thin mobile terminal device is squeezed by external force, the mobile terminal device is easily bent and deformed. As a result, the whole mobile terminal device is damaged and a function of the mobile terminal device is affected.

A housing of the mobile terminal device needs to provide enough structural strength support and protection and is not easily bent and deformed when the housing is subjected to specific external force. In addition, the mobile terminal device has a high requirement for an appearance. Therefore, finding a housing that can be applied to the mobile terminal device and has high strength and a good appearance is a breakthrough point in improving product competitiveness by each mobile terminal device manufacturer.

SUMMARY

In view of the above, embodiments of the present disclosure provide an aluminum alloy material and a housing made of the aluminum alloy material. The aluminum alloy material is applied to the housing such that the housing can have high strength and have a good appearance.

According to a first aspect, an embodiment of the present disclosure provides an aluminum alloy material, including zinc (also referred to as Zn) whose mass percentage is from 4.5% to 12.0%, magnesium (also referred to as Mg) whose mass percentage is from 0.7% to 3.0%, copper (also referred to as Cu) whose mass percentage is less than or equal to 0.6%, titanium (also referred to as Ti) whose mass percentage is from 0.001% to 0.5%, boron (also referred to as B) whose mass percentage is from 0.00011% to 0.2%, manganese (also referred to as Mn) whose mass percentage is less than or equal to 0.1%, chromium (also referred to as Cr) whose mass percentage is less than or equal to 0.2%, zirconium (also referred to as Zr) whose mass percentage is less than or equal to 0.2%, silicon (also referred to as Si) whose mass percentage is less than or equal to 0.3%, ferrum (also referred to as Fe) whose mass percentage is less than or equal to 0.3%, with the balance consisting of aluminum, and other inevitable impurities.

The aluminum alloy material provided in this embodiment of the present disclosure has high strength, and can obtain an aesthetic appearance through anodic oxidation treatment.

In a first possible implementation of the first aspect, the mass percentage of the zinc includes from 5.5% to 9.0%, the mass percentage of the magnesium includes from 1.0% to 1.8%, the mass percentage of the copper includes less than or equal to 0.03%, the mass percentage of the titanium includes from 0.005% to 0.1%, the mass percentage of the boron includes from 0.001% to 0.03%, the mass percentage of the manganese includes less than or equal to 0.02%, the mass percentage of the chromium includes less than or equal to 0.01%, the mass percentage of the zirconium includes less than or equal to 0.01%, the mass percentage of the silicon includes less than or equal to 0.1%, and the mass percentage of the ferrum includes less than or equal to 0.1%.

With reference to the first aspect or the first possible implementation of the first aspect, in a second possible implementation, the mass percentage of the zinc includes from 7.3% to 8.5%, the mass percentage of the magnesium includes from 1.2% to 1.5%, the mass percentage of the copper includes from 0.005% to 0.03%, the mass percentage of the titanium includes from 0.01% to 0.03%, the mass percentage of the boron includes from 0.003% to 0.006%, the mass percentage of the manganese includes from 0.001% to 0.015%, the mass percentage of the chromium includes from 0.0008% to 0.004%, the mass percentage of the zirconium includes less than or equal to 0.01%, the mass percentage of the silicon includes from 0.03% to 0.06%, and the mass percentage of the ferrum includes from 0.04% to 0.12%.

With reference to the first aspect or the first possible implementation of the first aspect, in a third possible implementation, the mass percentage of the zinc includes from 5.0% to 7.5%, the mass percentage of the magnesium includes from 0.9% to 1.2%, the mass percentage of the copper includes from 0.0001% to 0.006%, the mass percentage of the titanium includes from 0.01% to 0.02%, the mass percentage of the boron includes from 0.003% to 0.005%, the mass percentage of the manganese includes from 0.001% to 0.005%, the mass percentage of the chromium includes from 0.0005% to 0.002%, the mass percentage of the zirconium includes less than or equal to 0.01%, the mass percentage of the silicon includes from 0.03% to 0.06%, and the mass percentage of the ferrum includes from 0.04% to 0.12%.

With reference to any one of the first aspect, or the first to the third possible implementations of the first aspect, in a fourth possible implementation, a ratio of the mass percentage of the zinc to the mass percentage of the magnesium (or a ratio of a mass fraction of the zinc to a mass fraction of the magnesium or a ratio of mass of the zinc to mass of the magnesium) includes a ratio of zinc/magnesium is from 3 to 7.

When the ratio of the mass percentage of the zinc to the mass percentage of the magnesium is from 3 to 7, a good appearance can be obtained after anodizing is performed on the aluminum alloy material, for example, a delicate metal texture and/or a great variety of colors (such as silver, gold, and gray) are/is obtained.

With reference to the first aspect, in a fifth possible implementation, the mass percentage of the zinc may be any mass percentage within a range of 4.5% to 12.0%.

With reference to the first aspect, in a sixth possible implementation, a range of the mass percentage of the zinc may be a range between any two mass percentages within a range of 4.5% to 12.0%.

With reference to any one of the first aspect, or the fifth to the sixth possible implementations of the first aspect, in a seventh possible implementation, the mass percentage of the magnesium may be any mass percentage within a range of 0.7% to 3.0%.

With reference to any one of the first aspect, or the fifth to the sixth possible implementations of the first aspect, in an eighth possible implementation, a range of the mass percentage of the magnesium may be a range between any two mass percentages within a range of 0.7% to 3.0%.

With reference to any one of the first aspect, or the fifth to the eighth possible implementations of the first aspect, in a ninth possible implementation, the mass percentage of the copper may be any mass percentage less than or equal to 0.6%.

With reference to any one of the first aspect, or the fifth to the eighth possible implementations of the first aspect, in a tenth possible implementation, a range of the mass percentage of the copper may be a range between any two mass percentages less than or equal to 0.6%.

With reference to any one of the first aspect, or the fifth to the tenth possible implementations of the first aspect, in an eleventh possible implementation, the mass percentage of the titanium may be any mass percentage within a range of 0.001% to 0.5%.

With reference to any one of the first aspect, or the fifth to the tenth possible implementations of the first aspect, in a twelfth possible implementation, a range of the mass percentage of the titanium may be a range between any two mass percentages within a range of 0.001% to 0.5%.

With reference to any one of the first aspect, or the fifth to the twelfth possible implementations of the first aspect, in a thirteenth possible implementation, the mass percentage of the boron may be any mass percentage within a range of 0.00011% to 0.2%.

With reference to any one of the first aspect, or the fifth to the twelfth possible implementations of the first aspect, in a fourteenth possible implementation, a range of the mass percentage of the boron may be a range between any two mass percentages within a range of 0.00011% to 0.2%.

With reference to any one of the first aspect, or the fifth to the fourteenth possible implementations of the first aspect, in a fifteenth possible implementation, the mass percentage of the silicon may be any mass percentage less than or equal to 0.3%.

With reference to any one of the first aspect, or the fifth to the fourteenth possible implementations of the first aspect, in a sixteenth possible implementation, a range of the mass percentage of the silicon may be a range between any two mass percentages less than or equal to 0.3%.

With reference to any one of the first aspect, or the fifth to the sixteenth possible implementations of the first aspect, in a seventeenth possible implementation, the mass percentage of the manganese may be any mass percentage less than or equal to 0.1%.

With reference to any one of the first aspect, or the fifth to the sixteenth possible implementations of the first aspect, in an eighteenth possible implementation, a range of the mass percentage of the manganese may be a range between any two mass percentages less than or equal to 0.1%.

With reference to any one of the first aspect, or the fifth to the eighteenth possible implementations of the first aspect, in a nineteenth possible implementation, the mass percentage of the chromium may be any mass percentage less than or equal to 0.2%.

With reference to any one of the first aspect, or the fifth to the eighteenth possible implementations of the first aspect, in a twentieth possible implementation, a range of the mass percentage of the chromium may be a range between any two mass percentages less than or equal to 0.2%.

With reference to any one of the first aspect, or the fifth to the twentieth possible implementations of the first aspect, in a twenty-first possible implementation, the mass percentage of the zirconium may be any mass percentage less than or equal to 0.2%.

With reference to any one of the first aspect, or the fifth to the twentieth possible implementations of the first aspect, in a twenty-second possible implementation, a range of the mass percentage of the zirconium may be a range between any two mass percentages less than or equal to 0.2%.

With reference to any one of the first aspect, or the fifth to the twenty-second possible implementations of the first aspect, in a twenty-third possible implementation, the mass percentage of the ferrum may be any mass percentage less than or equal to 0.3%.

With reference to any one of the first aspect, or the fifth to the twenty-second possible implementations of the first aspect, in a twenty-fourth possible implementation, a range of the mass percentage of the ferrum may be a range between any two mass percentages less than or equal to 0.3%.

In the embodiments of the aluminum alloy material in the first aspect, the mass percentage of the zinc and the mass percentage of the magnesium may enable the zinc and the magnesium to form a compound $MgZn_2$. The $MgZn_2$ may be used as a main strengthening compound of the aluminum alloy material to improve mechanical performance (for example, mechanical properties of materials) of the aluminum alloy material. The improved mechanical performance includes at least one or more of tensile strength, yield strength, and hardness.

The mass percentage of the copper may enable the copper to combine with the zinc to form $CuAl_2$. The $CuAl_2$ can produce a significant effect in aging strengthening and increase strength of the aluminum alloy material. In addition, excessive copper does not lead to reduction in corrosion resistance of the aluminum alloy material. This helps the aluminum alloy material form a good appearance through anodizing. In a general case, less copper helps the aluminum alloy material form a better appearance through anodizing, and excessive copper makes an anodic oxide film yellow.

The mass percentage of the titanium may enable the titanium and the zinc to form an intermetallic compound $TiAl_3$. The intermetallic compound $TiAl_3$ can effectively refine a grain. This helps increase the strength of the aluminum alloy material.

The mass percentage of the boron may enable the boron, the titanium, and the zinc to form a compound or an intermediate compound such as $TiB_2$, $AlB_2$, or $(Al, Ti)B_2$ such that a quantity of effective nucleation particles is increased, an effect of refining a grain can be significantly improved, and the aluminum alloy material can have fine grains with great dimensional uniformity. This helps increase the strength of the aluminum alloy material. In addition, because the aluminum alloy material has fine grains with great dimensional uniformity, a probability that an obvious speckle appears on the aluminum alloy material after anodizing can be effectively reduced. This helps obtain an excellent appearance through anodizing.

The mass percentage of the silicon may enable the silicon and the magnesium to form a strengthening phase $Mg_2Si$ to increase the strength of the aluminum alloy material. In addition, excessive Si does not affect an appearance of the aluminum alloy material obtained through anodizing.

The manganese is an impurity element, and the mass percentage of the manganese can prevent the manganese, the ferrum, the silicon, and the zinc from generating excessive impurity compounds (for example, $Al_6(FeMn)$ and Al(Mn-Fe)Si). The impurity compound affects the appearance of the aluminum alloy material obtained through anodizing. For example, a stripe may appear on the aluminum alloy material after anodizing.

The chromium is an impurity element, and the mass percentage of the chromium can prevent excessive chromium of the aluminum alloy material from increasing quench sensitivity. If the aluminum alloy material has excessively high quench sensitivity, the anodic oxide film of the aluminum alloy material becomes yellow after anodizing. This is unfavorable for the aluminum alloy material to obtain an excellent appearance through anodizing.

The zirconium is an impurity element, and the mass percentage of the zirconium can avoid a case in which excessive zirconium leads to an unfavorable effect in obtaining an excellent appearance of the aluminum alloy material through anodizing.

The ferrum is an impurity element, and the mass percentage of the ferrum can avoid a case in which excessive ferrum leads to an unfavorable effect in obtaining an excellent appearance of the aluminum alloy material through anodizing.

According to a second aspect, an embodiment of the present disclosure provides an aluminum alloy material, including zinc whose mass percentage is from 4.5% to 12%, magnesium whose mass percentage is from 1.01% to 1.29%, copper whose mass percentage is less than or equal to 0.6%, titanium whose mass percentage is from 0.001% to 0.5%, manganese whose mass percentage is less than or equal to 0.1%, chromium whose mass percentage is less than or equal to 0.2%, zirconium whose mass percentage is less than or equal to 0.2%, silicon whose mass percentage is from 0.001% to 0.3%, ferrum whose mass percentage is less than or equal to 0.3%, aluminum, and other inevitable impurities.

The aluminum alloy material provided in this embodiment of the second aspect of the present disclosure has high strength, and can obtain an aesthetic appearance through anodic oxidation treatment.

In a first possible implementation of the second aspect, the mass percentage of the zinc includes from 5.0% to 8.0%, the mass percentage of the magnesium includes from 1.01% to 1.25%, the mass percentage of the copper includes less than or equal to 0.01%, the mass percentage of the titanium includes from 0.01% to 0.05%, the mass percentage of the manganese includes less than or equal to 0.01%, the mass percentage of the chromium includes less than or equal to 0.01%, the mass percentage of the zirconium includes less than or equal to 0.01%, the mass percentage of the silicon includes from 0.01% to 0.1%, and the mass percentage of the ferrum includes less than or equal to 0.1%.

In a second possible implementation of the second aspect, the mass percentage of the zinc includes from 5.2% to 5.9%, the mass percentage of the magnesium includes from 1.01% to 1.2%, the mass percentage of the copper includes from 0.002% to 0.006%, the mass percentage of the titanium includes from 0.01% to 0.02%, the mass percentage of the manganese includes from 0.001% to 0.005%, the mass percentage of the chromium includes from 0.0008% to 0.002%, the mass percentage of the zirconium includes less than or equal to 0.01%, the mass percentage of the silicon includes from 0.03% to 0.06%, and the mass percentage of the ferrum includes from 0.04% to 0.12%.

With reference to any one of the second aspect, or the first to the second possible implementations of the second aspect, in a third possible implementation, a ratio of the mass percentage of the zinc to the mass percentage of the magnesium (or a ratio of a mass fraction of the zinc to a mass fraction of the magnesium or a ratio of mass of the zinc to mass of the magnesium) includes a ratio of zinc/magnesium is from 3 to 7.

When the ratio of the mass percentage of the zinc to the mass percentage of the magnesium is from 3 to 7, a good appearance can be obtained after anodizing is performed on the aluminum alloy material, for example, a delicate metal texture and/or a great variety of colors (such as silver, gold, and gray) are/is obtained.

With reference to the second aspect, in a fourth possible implementation, the mass percentage of the zinc may be any mass percentage within a range of 4.5% to 12%.

With reference to the second aspect, in a fifth possible implementation, a range of the mass percentage of the zinc may be a range between any two mass percentages within a range of 4.5% to 12%.

With reference to any one of the second aspect, or the fourth to the fifth possible implementations of the second aspect, in a sixth possible implementation, the mass percentage of the magnesium may be any mass percentage within a range of 1.01% to 1.29%.

With reference to any one of the second aspect, or the fourth to the fifth possible implementations of the second aspect, in a seventh possible implementation, a range of the mass percentage of the magnesium may be a range between any two mass percentages within a range of 1.01% to 1.29%.

With reference to any one of the second aspect, or the fourth to the seventh possible implementations of the second aspect, in an eighth possible implementation, the mass percentage of the copper may be any mass percentage less than or equal to 0.6%.

With reference to any one of the second aspect, or the fourth to the seventh possible implementations of the second aspect, in a ninth possible implementation, a range of the mass percentage of the copper may be a range between any two mass percentages less than or equal to 0.6%.

With reference to any one of the second aspect, or the fourth to the ninth possible implementations of the second aspect, in a tenth possible implementation, the mass percentage of the titanium may be any mass percentage within a range of 0.001% to 0.5%.

With reference to any one of the second aspect, or the fourth to the ninth possible implementations of the second aspect, in an eleventh possible implementation, a range of the mass percentage of the titanium may be a range between any two mass percentages within a range of 0.001% to 0.5%.

With reference to any one of the second aspect, or the fourth to the eleventh possible implementations of the second aspect, in a twelfth possible implementation, the mass percentage of the silicon may be any mass percentage within a range of 0.001% to 0.3%.

With reference to any one of the second aspect, or the fourth to the eleventh possible implementations of the second aspect, in a thirteenth possible implementation, a range of the mass percentage of the silicon may be a range between any two mass percentages within a range of 0.001% to 0.3%.

With reference to any one of the second aspect, or the fourth to the thirteenth possible implementations of the second aspect, in a fourteenth possible implementation, the mass percentage of the manganese may be any mass percentage less than or equal to 0.1%.

With reference to any one of the second aspect, or the fourth to the thirteenth possible implementations of the second aspect, in a fifteenth possible implementation, a range of the mass percentage of the manganese may be a range between any two mass percentages less than or equal to 0.1%.

With reference to any one of the second aspect, or the fourth to the fifteenth possible implementations of the second aspect, in a sixteenth possible implementation, the mass percentage of the chromium may be any mass percentage less than or equal to 0.2%.

With reference to any one of the second aspect, or the fourth to the fifteenth possible implementations of the second aspect, in a seventeenth possible implementation, a range of the mass percentage of the chromium may be a range between any two mass percentages less than or equal to 0.2%.

With reference to any one of the second aspect, or the fourth to the seventeenth possible implementations of the second aspect, in an eighteenth possible implementation, the mass percentage of the zirconium may be any mass percentage less than or equal to 0.2%.

With reference to any one of the second aspect, or the fourth to the seventeenth possible implementations of the second aspect, in a nineteenth possible implementation, a range of the mass percentage of the zirconium may be a range between any two mass percentages less than or equal to 0.2%.

With reference to any one of the second aspect, or the fourth to the nineteenth possible implementations of the second aspect, in a twentieth possible implementation, the mass percentage of the ferrum may be any mass percentage less than or equal to 0.3%.

With reference to any one of the second aspect, or the fourth to the nineteenth possible implementations of the second aspect, in a twenty-first possible implementation, a range of the mass percentage of the ferrum may be a range between any two mass percentages less than or equal to 0.3%.

In the embodiments of the aluminum alloy material in the second aspect, the mass percentage of the zinc and the mass percentage of the magnesium may enable the zinc and the magnesium to form a compound $MgZn_2$. The $MgZn_2$ may be used as a main strengthening compound of the aluminum alloy material, to improve mechanical performance (for example, mechanical properties of materials) of the aluminum alloy material. The improved mechanical performance includes at least one or more of tensile strength, yield strength, and hardness.

The mass percentage of the copper may enable the copper to combine with the zinc to form $CuAl_2$. The $CuAl_2$ can produce a significant effect in aging strengthening and increase strength of the aluminum alloy material. In addition, excessive copper does not lead to reduction in corrosion resistance of the aluminum alloy material. This helps the aluminum alloy material form a good appearance through anodizing. In a general case, less copper helps the aluminum alloy material form a better appearance through anodizing, and excessive copper makes an anodic oxide film yellow.

The mass percentage of the titanium may enable the titanium and the zinc to form an intermetallic compound $TiAl_3$. The intermetallic compound $TiAl_3$ can effectively refine a grain. This helps increase the strength of the aluminum alloy material.

The mass percentage of the silicon may enable the silicon and the magnesium to form a strengthening phase $Mg_2Si$ to increase the strength of the aluminum alloy material. In addition, excessive Si does not affect an appearance of the aluminum alloy material obtained through anodizing. Further, the silicon helps refine an alloy grain, increase metal fluidity, and improve alloy casting performance and a heat treatment strengthening effect, thereby increasing the strength of the aluminum alloy material.

The manganese is an impurity element, and the mass percentage of the manganese can prevent the manganese, the ferrum, the silicon, and the zinc from generating excessive impurity compounds (for example, $Al_6$(FeMn) and Al(MnFe)Si). The impurity compound affects the appearance of the aluminum alloy material obtained through anodizing. For example, a stripe may appear on the aluminum alloy material after anodizing.

The chromium is an impurity element, and the mass percentage of the chromium can prevent excessive chromium of the aluminum alloy material from increasing quench sensitivity. If the aluminum alloy material has excessively high quench sensitivity, the anodic oxide film of the aluminum alloy material becomes yellow after anodizing. This is unfavorable for the aluminum alloy material to obtain an excellent appearance through anodizing.

The zirconium is an impurity element, and the mass percentage of the zirconium can avoid a case in which excessive zirconium leads to an unfavorable effect in obtaining an excellent appearance of the aluminum alloy material through anodizing.

The ferrum is an impurity element, and the mass percentage of the ferrum can avoid a case in which excessive ferrum leads to an unfavorable effect in obtaining an excellent appearance of the aluminum alloy material through anodizing.

According to a third aspect, an embodiment of the present disclosure provides an aluminum alloy sheet. The aluminum alloy sheet is made of an aluminum alloy material, and the aluminum alloy material includes one or more of the aluminum alloy material in the first aspect and the aluminum alloy material in the second aspect.

According to a fourth aspect, an embodiment of the present disclosure provides an aluminum alloy bar. The aluminum alloy bar is made of an aluminum alloy material, and the aluminum alloy material includes one or more of the aluminum alloy material in the first aspect and the aluminum alloy material in the second aspect.

According to a fifth aspect, an embodiment of the present disclosure provides a housing. The housing is fastened on an outer surface of an apparatus, and includes a base, and a fixing part disposed on the base, the base is approximately plate-shaped or box-shaped or cap-shaped or frame-shaped, the fixing part is configured to mount the housing with another component of the apparatus, the housing is made of an aluminum alloy material, and the aluminum alloy material includes one or more of the aluminum alloy material in the first aspect and the aluminum alloy material in the second aspect.

The aluminum alloy material in the first aspect and the aluminum alloy material in the second aspect that are provided in the embodiments of the present disclosure may be applied to housings of various apparatuses, to provide strong structural strength support for the apparatus and increase an anti-bending and anti-deformation capability of the apparatus. When the apparatus is subjected to external force, the apparatus is not easily deformed or bent such that strength of the whole apparatus is increased, and a bending damage rate of the whole apparatus is reduced.

In addition, the aluminum alloy material in the first aspect and the aluminum alloy material in the second aspect that are provided in the embodiments of the present disclosure have an excellent anodizing property such that a housing made of the various aluminum alloy materials can have an aesthetic appearance through anodizing, and a requirement of a user for a multi-color multi-texture industrial design (ID) appearance of a housing can be met. For example, a high-quality metal texture can be provided for the housing, to improve user experience.

According to a sixth aspect, an embodiment of the present disclosure provides an apparatus. The apparatus includes a housing and at least one component, the housing is fastened on an outer surface of the apparatus to form accommodation space, at least one component of the component is accommodated in the accommodation space, at least one part of the housing is made of an aluminum alloy material, and the aluminum alloy material includes one or more of the aluminum alloy material in the first aspect and the aluminum alloy material in the second aspect.

In the apparatus embodiment of the present disclosure, the at least one part of the housing is made of one or more of the aluminum alloy material in the first aspect and the aluminum alloy material in the second aspect. The housing not only provides better strength support and protection for the apparatus, but also can obtain a good appearance through anodizing, to provide a good decorative effect for the apparatus and improve user experience.

With reference to the sixth aspect, in a first possible implementation, the component includes one or more of an electronic component, a mechanical component, and an optical component.

DESCRIPTION OF EMBODIMENTS

Figure 1:
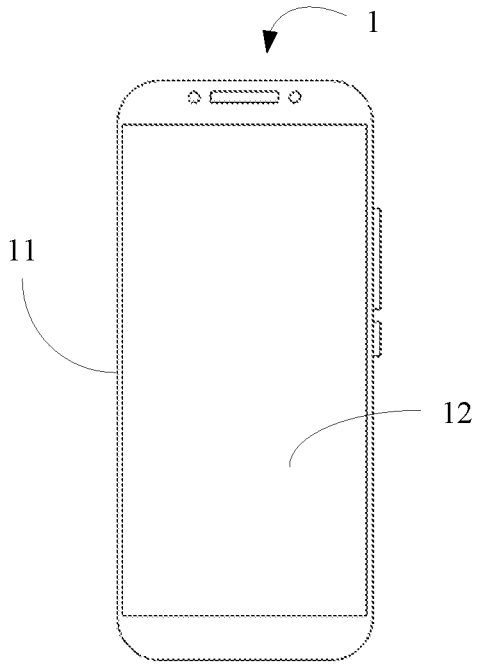
FIG. 1 is a schematic diagram of a front of a mobile phone according to an embodiment of the present disclosure.

An embodiment of the present disclosure provides an Al—Zn—Mg-based high-strength boron-containing aluminum alloy material. There may be four choices for a formula of the Al—Zn—Mg-based high-strength boron-containing aluminum alloy material. The four choices for the formula are listed in Table 1:

Boron-containing aluminum alloy material:

TABLE 1

| Components | First type of mass percentage (or mass fraction) | Second type of mass percentage (or mass fraction) | Third type of mass percentage (or mass fraction) | Fourth type of mass percentage (or mass fraction) |
|---|---|---|---|---|
| Zinc | 4.5%-12.0% | 5.5%-9.0% | 7.3%-8.5% | 5.0%-7.5% |
| Magnesium | 0.7%-3.0% | 1.0%-1.8% | 1.2%-1.5% | 0.9%-1.2% |
| Copper | ≥0.6% | ≤0.03% | 0.005%-0.03% | 0.0001%-0.006% |
| Titanium | 0.001%-0.5% | 0.005%-0.1% | 0.01%-0.03% | 0.01%-0.02% |
| Boron | 0.00011%-0.2% | 0.001%-0.03% | 0.003%-0.006% | 0.003%-0.005% |
| Manganese | ≤0.1% | ≤0.02% | 0.001%-0.015% | 0.001%-0.005% |
| Chromium | ≤0.2% | ≤0.01% | 0.0008%-0.004% | 0.0005%-0.002% |
| Zirconium | ≤0.2% | ≤0.01% | <0.01% | <0.01% |
| Silicon | ≤0.3% | ≤0.1% | 0.03%-0.06% | 0.03%-0.06% |
| Ferrum | ≤0.3% | ≤0.1% | 0.04%-0.12% | 0.04%-0.12% |

The rest is aluminum and other inevitable impurities

In Table 1, the second, the third or the fourth type of mass percentage (or mass fraction) of the components of the Al—Zn—Mg-based high-strength boron-containing aluminum alloy material is within a range of the first type of mass percentage (or mass fraction).

The following describes a function of each component and various mass percentages (or mass fractions) of each component in embodiments of different formulations of the boron-containing aluminum alloy material.

In terms of the zinc and the magnesium, in the embodiments of the boron-containing aluminum alloy material, a mass percentage of the zinc and a mass percentage of the magnesium may enable the zinc and the magnesium to form a compound $MgZn_2$. The $MgZn_2$ may be used as a main strengthening compound of the boron-containing aluminum alloy material to improve mechanical performance (for example, mechanical properties of materials) of the boron-containing aluminum alloy material. The improved mechanical performance includes at least one or more of tensile strength, yield strength, and hardness. In a specific implementation, a ratio of the mass percentage of the zinc to the mass percentage of the magnesium (or a ratio of a mass fraction of the zinc to a mass fraction of the magnesium or a ratio of mass of the zinc to mass of the magnesium) may include a ratio of zinc/magnesium is from 3 to 7. When the ratio of the mass percentage of the zinc to the mass percentage of the magnesium is from 3 to 7, a good appearance can be obtained after anodizing is performed on the boron-containing aluminum alloy material, for example, a delicate metal texture and/or a great variety of colors (such as silver, gold, and gray) are/is obtained. In a specific implementation, the mass percentage of the zinc may be any mass percentage within a range of 4.5% to 12.0%, and a range of the mass percentage of the zinc may be a range between any two mass percentages within a range of 4.5% to 12.0%. In a specific implementation, the mass percentage of the magnesium may be any mass percentage within a range of 0.7% to 3.0%, and a range of the mass percentage of the magnesium may be a range between any two mass percentages within a range of 0.7% to 3.0%.

In terms of the copper, in the embodiments of the boron-containing aluminum alloy material, a mass percentage of the copper may enable the copper to combine with the zinc to form $CuAl_2$. The $CuAl_2$ can produce a significant effect in aging strengthening and increase strength of the boron-containing aluminum alloy material. In addition, excessive copper does not lead to reduction in corrosion resistance of the boron-containing aluminum alloy material. This helps the boron-containing aluminum alloy material form a good appearance through anodizing. In a general case, less copper helps the boron-containing aluminum alloy material form a better appearance through anodizing, and excessive copper makes an anodic oxide film yellow. In a specific implementation, the mass percentage of the copper may be any mass percentage less than or equal to 0.6%, and a range of the mass percentage of the copper may be a range between any two mass percentages less than or equal to 0.6%.

In terms of the titanium, in the embodiments of the boron-containing aluminum alloy material, a mass percentage of the titanium may enable the titanium and the zinc to form an intermetallic compound $TiAl_3$. The intermetallic compound $TiAl_3$ can effectively refine a grain. This helps increase the strength of the boron-containing aluminum alloy material. In a specific implementation, the mass percentage of the titanium may be any mass percentage within a range of 0.001% to 0.5%, and a range of the mass percentage of the titanium may be a range between any two mass percentages within a range of 0.001% to 0.5%.

In terms of the boron, in the embodiments of the boron-containing aluminum alloy material, a mass percentage of the boron may enable the boron, the titanium, and the zinc to form a compound or an intermediate compound such as $TiB_2$, $A1B_2$, or $(A1,Ti)B_2$ such that a quantity of effective nucleation particles is increased, an effect of refining a grain can be significantly improved, and the boron-containing aluminum alloy material can have fine grains with great dimensional uniformity. This helps increase the strength of the boron-containing aluminum alloy material. In addition, because the boron-containing aluminum alloy material has fine grains with great dimensional uniformity, a probability that an obvious speckle appears on the boron-containing aluminum alloy material after anodizing can be effectively reduced. This helps obtain an excellent appearance through anodizing. In a specific implementation, the mass percentage of the boron may be any mass percentage within a range of 0.00011% to 0.2%, and a range of the mass percentage of the boron may be a range between any two mass percentages within a range of 0.00011% to 0.2%.

In terms of the silicon, in the embodiments of the boron-containing aluminum alloy material, a mass percentage of the silicon may enable the silicon and the magnesium to form a strengthening phase $Mg_2Si$, to increase the strength of the boron-containing aluminum alloy material. In addition, excessive Si does not affect an appearance of the boron-containing aluminum alloy material obtained through anodizing. In a specific implementation, the mass percentage of the silicon may be any mass percentage less than or equal to 0.3%, and a range of the mass percentage of the silicon may be a range between any two mass percentages less than or equal to 0.3%.

In terms of the manganese, in the embodiments of the boron-containing aluminum alloy material, the manganese is an impurity element, and a mass percentage of the manganese can prevent the manganese, the ferrum, the silicon, and the zinc from generating excessive impurity compounds (for example, $Al_6(FeMn)$ and Al(MnFe)Si). The impurity compound affects the appearance of the boron-containing aluminum alloy material obtained through anodizing. For example, a stripe may appear on the boron-containing aluminum alloy material after anodizing. In a specific implementation, the mass percentage of the manganese may be any mass percentage less than or equal to 0.1%, and a range of the mass percentage of the manganese may be a range between any two mass percentages less than or equal to 0.1%.

In terms of the chromium, in the embodiments of the boron-containing aluminum alloy material, the chromium is an impurity element, and a mass percentage of the chromium can prevent excessive chromium of the boron-containing aluminum alloy material from increasing quench sensitivity. If the boron-containing aluminum alloy material has excessively high quench sensitivity, the anodic oxide film of the boron-containing aluminum alloy material becomes yellow after anodizing. This is unfavorable for the boron-containing aluminum alloy material to obtain an excellent appearance through anodizing. In a specific implementation, the mass percentage of the chromium may be any mass percentage less than or equal to 0.2%, and a range of the mass percentage of the chromium may be a range between any two mass percentages less than or equal to 0.2%.

In terms of the zirconium, in the embodiments of the boron-containing aluminum alloy material, the zirconium is an impurity element, and a mass percentage of the zirconium can avoid a case in which excessive zirconium leads to an unfavorable effect in obtaining an excellent appearance of the boron-containing aluminum alloy material through anodizing. In a specific implementation, the mass percentage of the zirconium may be any mass percentage less than or equal to 0.2%, and a range of the mass percentage of the zirconium may be a range between any two mass percentages less than or equal to 0.2%.

In terms of the ferrum, in the embodiments of the boron-containing aluminum alloy material, the ferrum is an impurity element, and a mass percentage of the ferrum can avoid a case in which excessive ferrum leads to an unfavorable effect in obtaining an excellent appearance of the boron-containing aluminum alloy material through anodizing. In a specific implementation, the mass percentage of the ferrum may be any mass percentage less than or equal to 0.3%, and a range of the mass percentage of the ferrum may be a range between any two mass percentages less than or equal to 0.3%.

In view of the above, as an Al—Zn—Mg-based boron-containing aluminum alloy material, the boron-containing aluminum alloy material provided in the embodiments of present disclosure has high strength and can obtain an aesthetic appearance through anodic oxidation treatment.

Aluminum Alloy Material (B-Free)

An embodiment of the present disclosure further provides an Al—Zn—Mg-based high-strength boron-free aluminum alloy material. There may be three choices for a formula of the Al—Zn—Mg-based high-strength boron-free aluminum alloy material. The three choices for the formula are listed in Table 2:

Boron-free aluminum alloy material:

TABLE 2

| Components | First type of mass percentage (mass fraction) | Second type of mass percentage (mass fraction) | Third type of mass percentage (mass fraction) |
|---|---|---|---|
| Zinc | 4.5%-12% | 5.0%-8.0% | 5.2%-5.9% |
| Magnesium | 1.01%-1.29% | 1.01%-1.25% | 1.01%-1.2% |
| Copper | ≤0.6% | ≤0.01% | 0.002%-0.006% |
| Titanium | 0.001%-0.5% | 0.01%-0.05% | 0.01%-0.02% |
| Manganese | ≤0.1% | ≤0.01% | 0.001%-0.005% |
| Chromium | ≤0.2% | ≤0.01% | 0.0008%-0.002% |
| Zirconium | ≤0.2% | ≤0.01% | <0.01% |
| Silicon | 0.001%-0.3% | 0.01%-0.1% | 0.03%-0.06% |
| Ferrum | ≤0.3% | ≤0.1% | 0.04%-0.12% |

The rest is aluminum and other inevitable impurities

In Table 2, the second or the third type of mass percentage (or mass fraction) of the components of the Al—Zn—Mg-based high-strength boron-free aluminum alloy material is within a range of the first type of mass percentage (or mass fraction).

The following describes a function of each component and various mass percentages (or mass fractions) of each component in embodiments of different formulations of the boron-free aluminum alloy material.

In terms of the zinc and the magnesium, in the embodiments of the boron-free aluminum alloy material, a function of the zinc and a function of the magnesium are the same as or similar to a function of the zinc and a function of the magnesium in the embodiments of the boron-containing aluminum alloy material. In a specific implementation, a ratio of a mass percentage of the zinc to a mass percentage of the magnesium (or a ratio of a mass fraction of the zinc to a mass fraction of the magnesium or a ratio of mass of the zinc to mass of the magnesium) may be a ratio of zinc/magnesium is from 3 to 7. When the ratio of the mass percentage of the zinc to the mass percentage of the magnesium is from 3 to 7, a good appearance can be obtained after anodizing is performed on the boron-containing aluminum alloy material, for example, a delicate metal texture and/or a great variety of colors (such as silver, gold, and gray) are/is obtained. In a specific implementation, the mass percentage of the zinc may be any mass percentage within a range of 4.5% to 12%, and a range of the mass percentage of the zinc may be a range between any two mass percentages within a range of 4.5% to 12%. In a specific implementation, the mass percentage of the magnesium may be any mass percentage within a range of 1.01% to 1.29%, and a range of the mass percentage of the magnesium may be a range between any two mass percentages within a range of 1.01% to 1.29%.

In terms of the copper, in the embodiments of the boron-free aluminum alloy material, a function of the copper is the same as or similar to a function of the copper in the embodiments of the boron-containing aluminum alloy material. In a specific implementation, the mass percentage of the copper may be any mass percentage less than or equal to 0.6%, and a range of the mass percentage of the copper may be a range between any two mass percentages less than or equal to 0.6%.

In terms of the titanium, in the embodiments of the boron-free aluminum alloy material, a function of the titanium is the same as or similar to a function of the titanium in the embodiments of the boron-containing aluminum alloy material. In a specific implementation, the mass percentage of the titanium may be any mass percentage within a range of 0.001% to 0.5%, and a range of the mass percentage of the titanium may be a range between any two mass percentages within a range of 0.001% to 0.5%.

In terms of the silicon, in the embodiments of the boron-free aluminum alloy material, because boron is not included, a mass percentage of the silicon may enable the silicon and the magnesium to form a strengthening phase $Mg_2Si$ to improve strength of the aluminum alloy material. In addition, excessive Si does not affect an appearance of the aluminum alloy material obtained through anodizing. Further, the silicon helps refine an alloy grain, increase metal fluidity, and improve alloy casting performance and a heat treatment strengthening effect, thereby increasing the strength of the boron-free aluminum alloy material. In a specific implementation, the mass percentage of the silicon may be any mass percentage within a range of 0.001% to 0.3%, and a range of the mass percentage of the silicon may be a range between any two mass percentages within a range of 0.001% to 0.3%.

In terms of the manganese, in the embodiments of the boron-free aluminum alloy material, the manganese is an impurity element, and a function of the manganese is the same as or similar to a function of the manganese in the embodiments of the boron-containing aluminum alloy material. In a specific implementation, the mass percentage of the manganese may be any mass percentage less than or equal to 0.1%, and a range of the mass percentage of the manganese may be a range between any two mass percentages less than or equal to 0.1%.

In terms of the chromium, in the embodiments of the boron-free aluminum alloy material, the chromium is an impurity element, and a function of the chromium is the same as or similar to a function of the chromium in the embodiments of the boron-containing aluminum alloy material. In a specific implementation, the mass percentage of the chromium may be any mass percentage less than or equal to 0.2%, and a range of the mass percentage of the chromium may be a range between any two mass percentages less than or equal to 0.2%.

In terms of the zirconium, in the embodiments of the boron-free aluminum alloy material, the zirconium is an impurity element, and a function of the zirconium is the same as or similar to a function of the zirconium in the embodiments of the boron-containing aluminum alloy material. In a specific implementation, the mass percentage of the zirconium may be any mass percentage less than or equal to 0.2%, and a range of the mass percentage of the zirconium may be a range between any two mass percentages less than or equal to 0.2%.

In terms of the ferrum, in the embodiments of the boron-free aluminum alloy material, the ferrum is an impurity element, and a function of the ferrum is the same as or similar to a function of the ferrum in the embodiments of the boron-containing aluminum alloy material. In a specific implementation, the mass percentage of the ferrum may be any mass percentage less than or equal to 0.3%, and a range of the mass percentage of the ferrum may be a range between any two mass percentages less than or equal to 0.3%.

In view of the above, as an Al—Zn—Mg-based aluminum alloy material, the boron-free aluminum alloy material provided in the embodiments of present disclosure has high strength and can obtain an aesthetic appearance through anodic oxidation treatment.

Aluminum Alloy Bar or Sheet

An aluminum alloy sheet is provided. The aluminum alloy sheet is made of an aluminum alloy material, and the aluminum alloy material includes one or more of the various boron-containing aluminum alloy materials and the various boron-free aluminum alloy materials in the foregoing embodiments.

In a specific implementation, the aluminum alloy sheet may be an aluminum alloy profile or a rolled aluminum sheet.

An aluminum alloy bar is provided. The aluminum alloy bar is made of an aluminum alloy material, and the aluminum alloy material includes one or more of the various boron-containing aluminum alloy materials and the various boron-free aluminum alloy materials in the foregoing embodiments.

In a specific implementation, the aluminum alloy bar may be an aluminum alloy casting rod.

Housing

A housing is provided. The housing is fastened on an outer surface of an apparatus, and includes a base, and a fixing part disposed on the base. The base is approximately plate-shaped or box-shaped or cap-shaped or frame-shaped, the fixing part is configured to mount the housing with another component of the apparatus, the housing is made of an aluminum alloy material, and the aluminum alloy material includes one or more of the various boron-containing aluminum alloy materials and the various boron-free aluminum alloy materials described above.

The various boron-containing aluminum alloy materials and the various boron-free aluminum alloy materials provided in the foregoing embodiments of the present disclosure may be applied to housings of various apparatuses, to provide strong structural strength support for the apparatus and increase an anti-bending and anti-deformation capability of the apparatus. When the apparatus is subjected to external force, the apparatus is not easily deformed or bent such that strength of the whole apparatus is increased, and a bending damage rate of the whole apparatus is reduced.

In addition, the various boron-containing aluminum alloy materials and the various boron-free aluminum alloy materials provided in the foregoing embodiments of the present disclosure have an excellent anodizing property such that a housing made of the various aluminum alloy materials can have an aesthetic appearance through anodizing, and a requirement of a user for a multi-color multi-texture ID appearance of a housing can be met. For example, a high-quality metal texture can be provided for the housing, to improve user experience.

It can be learned from tests performed on a housing made of an existing aluminum alloy material and on a housing made of the aluminum alloy material in the foregoing embodiments of the present disclosure that, the housing made of the aluminum alloy material provided in the embodiments of the present disclosure is improved in three aspects tensile strength, yield strength, and Vickers hardness. For details, refer to Table 3.

TABLE 3

| Test items | Tensile strength (unit: megapascals (MPa)) | Yield strength (unit: MPa) | Vickers hardness (unit: Vickers pyramid number (HV)) | Appearance obtained through anodizing |
|---|---|---|---|---|
| Housing made of an existing 5 series or 6 series aluminum alloy material that is applicable to anodizing | ≤250 | ≤230 | ≤100 | Good |
| Housing made of a boron-containing aluminum alloy material of a first type of mass percentage | ≥320 | ≥300 | ≥100 | Good |
| Housing made of a boron-containing aluminum alloy material of a third type of mass percentage | ≥430 | ≥400 | ≥150 | Good |
| Housing made of a boron-containing aluminum alloy material of a fourth type of mass percentage | ≥380 | ≥350 | ≥140 | Good |
| Housing made of a boron-free aluminum alloy material of a first type of mass percentage | ≥320 | ≥300 | ≥100 | Good |
| Housing made of a boron-free aluminum alloy material of a second or third type of mass percentage | ≥3504 | ≥330 | ≥120 | Good |

In view of the above, the yield strength of the housing made of the aluminum alloy material in the foregoing embodiments of the present disclosure is increased by at least 30%. Strength increase of the housing helps increase an anti-bending capability of an apparatus on which the housing is installed. A specific increase range is further related to the housing of the apparatus and a structure of the whole apparatus. Further, yield strength of the housing made of the boron-containing aluminum alloy material of a third type of formula (the third type of mass percentage) is increased by more than 70% in comparison with the housing made of the existing aluminum alloy material, and yield strength of the housing made of the boron-containing aluminum alloy material of a fourth type of formula (the fourth type of mass percentage) is increased by more than 50% in comparison with the housing made of the existing aluminum alloy material.

Apparatus

An embodiment of the present disclosure further provides an apparatus. The apparatus includes a housing and at least one component. The housing is fastened on an outer surface of the apparatus to form accommodation space, at least one component of the component is accommodated in the accommodation space, at least one part of the housing is made of an aluminum alloy material, and the aluminum alloy material includes one or more of the various boron-containing aluminum alloy materials and the various boron-free aluminum alloy materials.

In the apparatus embodiment of the present disclosure, the at least one part of the housing is made of at least one of the various aluminum alloy materials provided in the foregoing embodiments. The housing not only provides better strength support and protection for the apparatus, but also can obtain a good appearance through anodizing to provide a good decorative effect for the apparatus and improve user experience.

In the apparatus embodiment of the present disclosure, the component may include one or more of an electronic component, a mechanical component, and an optical component.

The apparatus may include a mobile terminal device, a storage apparatus, an intelligent wearing device, a personal healthcare apparatus, an electronic dictionary, an electronic learning machine, a personal electronic apparatus, a camera, a household appliance, an electronic toy, a game console, a beauty instrument, a healthcare instrument, a massage instrument, a physiotherapy device, an air purifier, a bicycle, an electric balance car, fitness equipment, various speakers, or the like.

The mobile terminal device may include a mobile phone, a notebook computer, a tablet computer, a personal computer, a point of sale (POS) machine, a vehicle-mounted computer, an event data recorder, a Moving Picture Experts Group (MPEG) Audio Layer 3 (MP3) player, an MPEG 4 (MP4) player, a personal entertainment electronic device, an ebook reader, a router, a set top box, a projector, an electronic album, or the like. The mobile phone includes a smartphone, a feature phone, or the like.

The storage apparatus includes a Universal Serial Bus (USB) (or U) disk, a removable hard disk, a memory card, or the like.

The intelligent wearing device includes a smart band, a smartwatch, smart glasses, or the like.

The following describes several specific examples of the apparatus.

Figure 2:
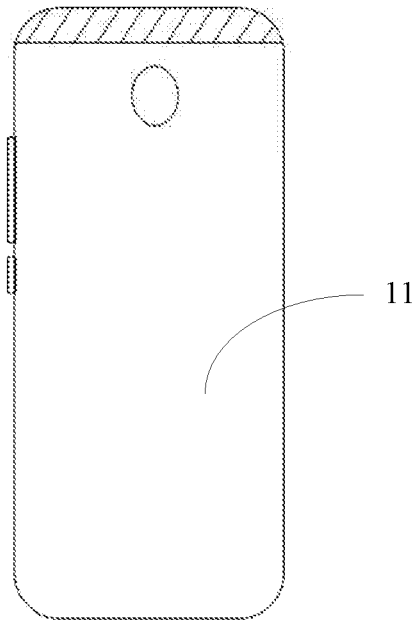
FIG. 2 is a schematic diagram of a housing on the back of a mobile phone according to an embodiment of the present disclosure.
Figure 3:
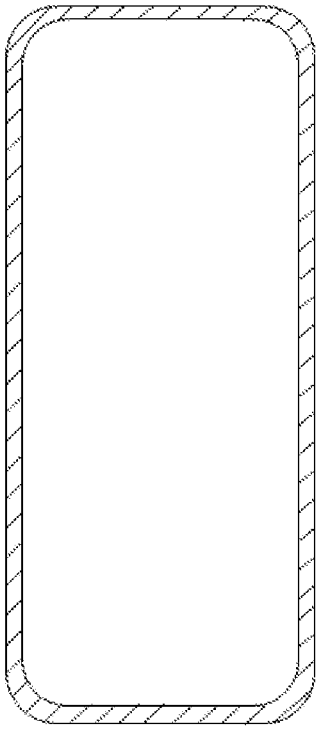
FIG. 3 is a schematic diagram of an aluminum alloy frame in a housing of a mobile phone according to another embodiment of the present disclosure.

As shown in FIG. 1 and FIG. 2, when the apparatus is a mobile phone 1, the component includes at least a circuit board, a battery, an antenna, and a screen 12 (also referred to as a "display screen"). A housing 11 and the screen 12 are fastened on an outer surface of the mobile phone 1 to form accommodation space. The circuit board and the battery are accommodated in the accommodation space, and the antenna is accommodated in the accommodation space or protrudes out of the housing 11. FIG. 1 shows a front of the mobile phone 1, and FIG. 2 is a schematic diagram of the housing 11 on the back of the mobile phone 1. FIG. 3 shows an aluminum alloy frame in another housing 11. The aluminum alloy frame is made of an aluminum alloy material, and the aluminum alloy material includes one or more of the various boron-containing aluminum alloy materials and the various boron-free aluminum alloy materials described above. The housing 11 includes a back cover in addition to the aluminum alloy frame, and the back cover is made of at least one of plastic, glass, and ceramic.

In a specific implementation, the mobile phone 1 may further include a bracket, and the bracket is configured to fasten the circuit board, the battery, and the antenna (when the antenna is located in the accommodation space) in the accommodation space.

In another specific implementation, the screen 12 may be a touchscreen (also referred to as a "touchscreen" or a "touch panel"), and there may be a plurality of screens 12. In an implementation, the screen 12 may be located on an outer surface on a front side of the mobile phone 1, and occupy the entire or a part of the outer surface on the front side.

Figure 4:
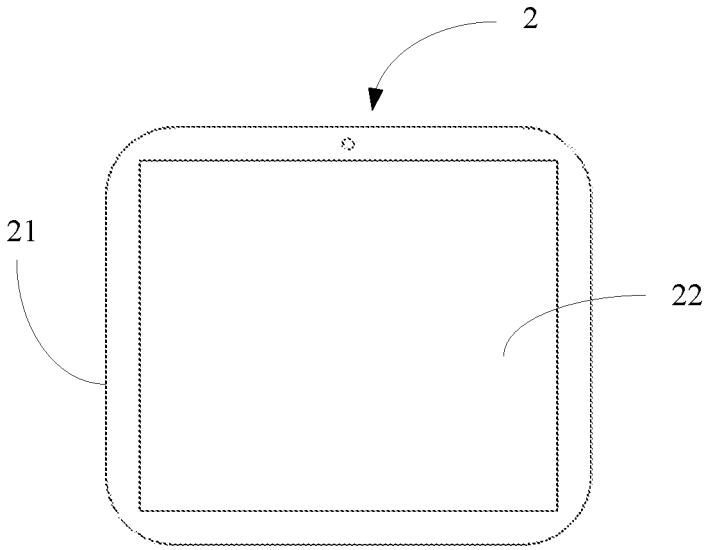
FIG. 4 is a schematic diagram of a front of a tablet computer according to an embodiment of the present disclosure.
Figure 5:
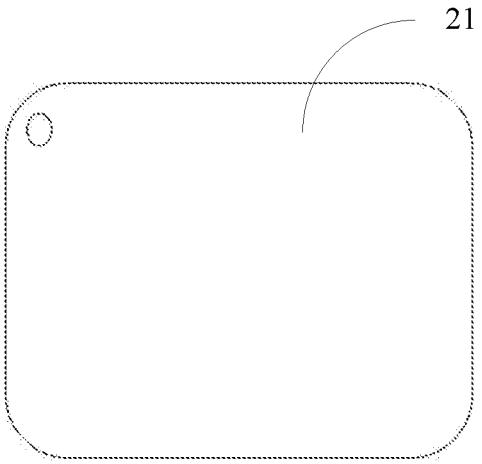
FIG. 5 is a schematic diagram of a housing on the back of a tablet computer according to an embodiment of the present disclosure.

As shown in FIG. 4 and FIG. 5, when the apparatus is a tablet computer 2, the component includes at least a battery, a circuit board, and a screen 22 (also referred to as a "display screen"). A housing 21 and the screen 22 are fastened on an outer surface of the tablet computer 2 to form accommodation space. The battery and the circuit board are accommodated in the accommodation space. FIG. 4 shows a front of the tablet computer 2, and FIG. 5 shows the housing 21 on the back of the tablet computer 2.

In a specific implementation, the screen 22 may be a touchscreen (also referred to as a "touchscreen" or a "touch panel"), and there may be a plurality of screens 22. In a specific implementation, the screen 22 may be located on an outer surface on a front side of the tablet computer 2, and occupy the entire or a part of the outer surface on the front side.

Figure 6:
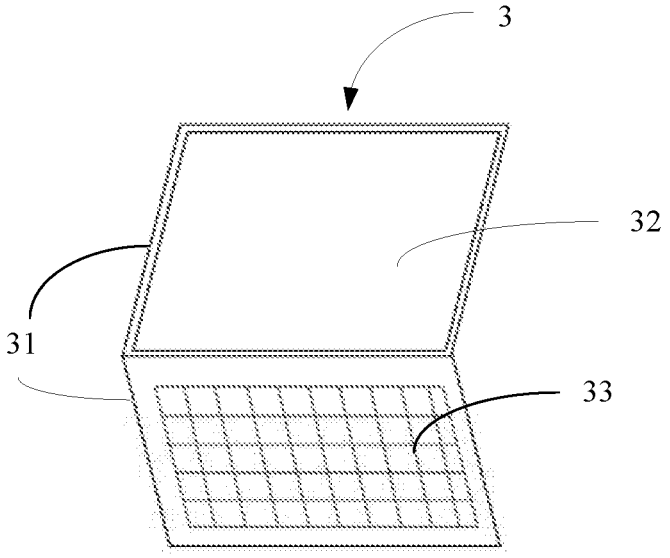
FIG. 6 is a schematic diagram of a front of a notebook computer according to an embodiment of the present disclosure.
Figure 7:
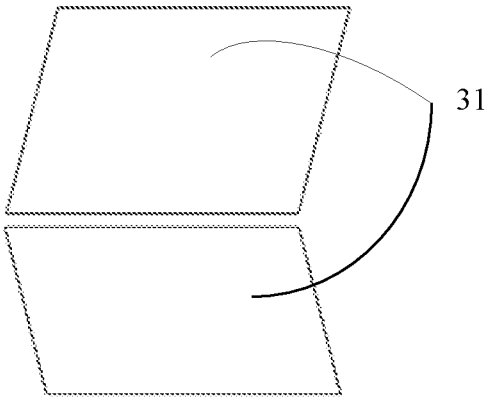
FIG. 7 is a schematic diagram of a housing on the back of a notebook computer according to an embodiment of the present disclosure.

As shown in FIG. 6 and FIG. 7, when the apparatus is a notebook computer 3, the component includes at least a battery, a circuit board, a keyboard 33, and a screen 32 (also referred to as a "display screen"). A housing 31, the keyboard 33, and the screen 32 are fastened on an outer surface of the notebook computer 3 to form accommodation space. The battery and the circuit board are accommodated in the accommodation space. FIG. 6 shows a front of the notebook computer 3, and FIG. 7 shows the housing 31 on the back of the notebook computer 3.

In a specific implementation, the screen 32 may be a touchscreen (also referred to as a "touchscreen" or a "touch panel"), and there may be a plurality of screens 32.

Figure 8:
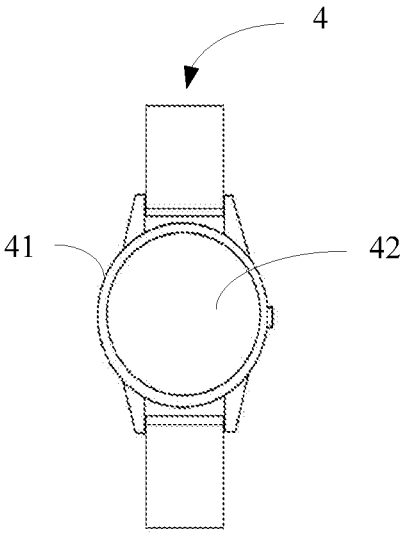
FIG. 8 is a schematic diagram of a front of a smartwatch/smart band according to an embodiment of the present disclosure.
Figure 9:
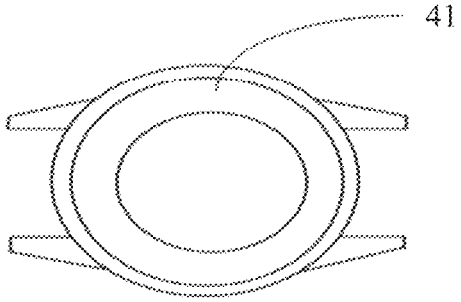
FIG. 9 is a schematic diagram of a housing on the back of a smartwatch/smart band according to an embodiment of the present disclosure.

As shown in FIG. 8 and FIG. 9, when the apparatus is a smartwatch/smart band 4, the component includes at least a battery, a circuit board, a band, and a screen 42 (also referred to as a "display screen"). A housing 41 and the screen 42 are fastened on an outer surface of the smartwatch/smart band 4 to form accommodation space. The battery and the circuit board are accommodated in the accommodation space. FIG. 8 shows a front of the smartwatch/smart band 4, and FIG. 9 shows the housing 41 on the back of the smartwatch/smart band 4.

In a specific implementation, the screen 42 may be a touchscreen (also referred to as a "touchscreen" or a "touch panel"), and there may be a plurality of screens 42.

In the descriptions of the present disclosure, it should be understood that "-" and "~" indicate a range between two values, and the range includes endpoints. For example, "A-B" indicates a range in which a value is greater than or equal to A and less than or equal to B, and "A~B" indicates a range in which a value is greater than or equal to A and less than or equal to B.

In addition, the term "and/or" in this specification describes only an association relationship for describing associated objects and represents that three relationships may exist. For example, A and/or B may represent the following three cases Only A exists, both A and B exist, and only B exists. In addition, the character "/" in this specification generally indicates an "or" relationship between the associated objects.

In the descriptions of this specification, the specific features, structures, materials, or characteristics may be combined in a proper manner in any one or more of the embodiments or examples.

What is claimed is:

1. An aluminum alloy material comprising:

zinc whose mass percentage comprises from 7.3% to 8.5%;

magnesium whose mass percentage comprises from 1.2% to 1.5%;

copper whose mass percentage comprises from 0.005% to 0.03%;

titanium whose mass percentage comprises from 0.01% to 0.03%;

boron whose mass percentage comprises from 0.003% to 0.006%;

manganese whose mass percentage comprises from 0.001% to 0.015%;

chromium whose mass percentage comprises from 0.0008% to 0.004%;

zirconium whose mass percentage comprises less than or equal to 0.01%;

silicon whose mass percentage comprises from 0.03% to 0.06%;

ferrum whose mass percentage comprises from 0.04% to 0.12%; and a balance comprises aluminum and inevitable impurities.

2. The aluminum alloy material of claim 1, wherein a ratio of the mass percentage of the zinc to the mass percentage of the magnesium comprises from three to seven.

3. The aluminum alloy material of claim 1, wherein a ratio of a mass fraction of the zinc to a mass fraction of the magnesium comprises from three to seven.

4. The aluminum alloy material of claim 1, wherein a ratio of mass of the zinc to mass of the magnesium comprises from three to seven.

5. An aluminum alloy material comprising:

zinc whose mass percentage comprises from 5.0% to 7.5%;

magnesium whose mass percentage comprises from 0.9% to 1.2%;

copper whose mass percentage comprises from 0.0001% to 0.006%;

titanium whose mass percentage comprises from 0.01% to 0.02%;

boron whose mass percentage comprises from 0.003% to 0.005%;

manganese whose mass percentage comprises from 0.001% to 0.005%;

chromium whose mass percentage comprises from 0.0005% to 0.002%;

zirconium whose mass percentage comprises less than or equal to 0.01%;

silicon whose mass percentage comprises from 0.03% to 0.06%;

ferrum whose mass percentage comprises from 0.04% to 0.12%; and a balance comprises aluminum and inevitable impurities.

6. The aluminum alloy material of claim 5, wherein a ratio of the mass percentage of the zinc to the mass percentage of the magnesium comprises from three to seven.

7. The aluminum alloy material of claim 5, wherein a ratio of a mass fraction of the zinc to a mass fraction of the magnesium comprises from three to seven.

8. The aluminum alloy material of claim 5, wherein a ratio of mass of the zinc to mass of the magnesium comprises from three to seven.

9. An aluminum alloy material comprising:

zinc whose mass percentage comprises from 5.2% to 5.9%;

magnesium whose mass percentage comprises from 1.01% to 1.2%;

copper whose mass percentage comprises from 0.002% to 0.006%;

titanium whose mass percentage comprises from 0.01% to 0.02%;

manganese whose mass percentage comprises from 0.001% to 0.005%;

chromium whose mass percentage comprises from 0.0008% to 0.002%;

zirconium whose mass percentage comprises less than or equal to 0.01%;

silicon whose mass percentage comprises from 0.03% to 0.06%;

ferrum whose mass percentage comprises from 0.04% to 0.12%;

aluminum; and inevitable impurities.

10. The aluminum alloy material of claim 9, wherein a ratio of the mass percentage of the zinc to the mass percentage of the magnesium comprises from three to seven.

11. The aluminum alloy material of claim 9, wherein a ratio of a mass fraction of the zinc to a mass fraction of the magnesium comprises from three to seven.

12. The aluminum alloy material of claim 9, wherein a ratio of mass of the zinc to mass of the magnesium comprises from three to seven.

* * * * *